US005678733A

United States Patent [19]

Ong

[11] Patent Number: 5,678,733

[45] Date of Patent: *Oct. 21, 1997

[54] LIQUID CLEANER DISPENSER

[76] Inventor: Bon S. Ong, P.O. Box 4247, Torrance, Calif. 90510

[ * ] Notice: The term of this patent shall not extend beyond the expiration date of Pat. No. 5,507,414.

[21] Appl. No.: 631,961

[22] Filed: Apr. 15, 1996

Related U.S. Application Data

[63] Continuation of Ser. No. 219,085, Mar. 28, 1994, Pat. No. 5,507,414.

[51] Int. Cl.[6] ..... B67D 1/16

[52] U.S. Cl. ..... 222/108; 4/559; 211/65; 222/173; 222/181.1; 222/181.3; 222/192; 222/510; 222/518

[58] Field of Search ..... 222/108, 173, 222/184, 192, 510, 518, 559, 181.1, 181.2, 181.3; 141/86; 4/559, 605; 211/65, 71, 74; D6/527–529, 534, 542

[56] References Cited

U.S. PATENT DOCUMENTS

| | | | |
|---|---|---|---|
| 576,241 | 2/1897 | Van Ame | 222/181.1 X |
| 1,043,656 | 11/1912 | Ziringer | 222/510 |
| 1,220,753 | 3/1917 | Kees | 222/181.2 X |
| 1,449,571 | 3/1923 | Younger | 222/510 X |
| 1,551,434 | 8/1925 | Shiffer . | |
| 1,734,821 | 11/1929 | Miller | 222/181.2 X |
| 1,892,992 | 1/1933 | Moran et al. | 222/181.1 |
| 1,941,751 | 1/1934 | Lupo | 222/510 X |
| 1,943,647 | 1/1934 | Weller | 222/130 |
| 2,175,933 | 10/1939 | Walrod | 222/510 X |
| 2,349,665 | 5/1944 | Levit | 222/510 X |
| 2,536,419 | 1/1951 | Brunell et al. | 222/181.2 X |
| 2,552,817 | 5/1951 | Ross | 222/108 |
| 2,670,105 | 2/1954 | Huhn | 222/181.2 X |
| 2,956,587 | 10/1960 | Robichaud | 211/74 |
| 3,008,609 | 11/1961 | Sessions | 222/130 |
| 3,204,823 | 9/1965 | Watson, Jr. . | |
| 3,344,958 | 10/1967 | Kaanehe | 222/181.2 |
| 3,599,684 | 8/1971 | Elias | 222/192 X |
| 3,966,055 | 6/1976 | Francavilla | 211/65 |
| 4,472,843 | 9/1984 | Chermak | 4/559 |
| 4,548,340 | 10/1985 | Messer | 222/192 X |
| 4,880,145 | 11/1989 | McManus | 4/605 X |
| 5,139,172 | 8/1992 | Brown | 222/181.2 |
| 5,277,344 | 1/1994 | Jenkins | 222/518 X |
| 5,375,739 | 12/1994 | Grandfelt | 222/518 X |

*Primary Examiner*—Kevin P. Shaver
*Attorney, Agent, or Firm*—Charles H. Thomas

[57] ABSTRACT

An apparatus is provided for dispensing liquid cleaning substances and is particularly useful for dispensing dishwashing detergents. The device is formed with a base and a means for supporting a liquid detergent container above the base. This support may take the form of an encircling wall that defines an enclosure for a pump style detergent container having a laterally projecting spout mounted in its mouth, or an upright stanchion that holds a detergent container at an elevated level above the base. In either event the device is provided with a concave, upwardly facing liquid detergent receptacle located atop the base and directly beneath the dispensing orifice of the liquid detergent container. A sponge support is formed atop the liquid detergent receptacle. The sponge support may include a mesh screen and is hinged relative to the base to rotate about a horizontal axis. The sponge support may be moved between a lowered, horizontal disposition directly above the liquid detergent receptacle and a raised disposition out of vertical alignment between the dispensing orifice and the liquid detergent receptacle. The sponge support provides a convenient place for storing a kitchen sponge, and also allows the sponge to dry out.

6 Claims, 4 Drawing Sheets

LIQUID CLEANER DISPENSER

The present application is a continuation of U.S. application Ser. No. 08/219,085 filed Mar. 28, 1994, now U.S. Pat. No. 5,507,414.

BACKGROUND OF THE INVENTION

1. Field of the Invention

The present invention relates to an apparatus for dispensing a liquid cleaning substance, and has particular application to the dispensation of liquid dishwashing detergent.

2. Description of the Prior Art

At present, liquid cleaners, such as dishwashing detergent, are packaged and sold commercially in plastic squeeze bottles or plastic containers having an open mouth with a hand pump mechanism installed therein. Conventional plastic squeeze bottles for holding liquid dishwashing detergent typically have a rather tall and narrow configuration. This is necessary so that the body of the dishwashing detergent container will fit within a user's hand and allow the user to squeeze the container from the opposite sides, using one hand, in order to eject the desired amount of dishwashing detergent. However, by virtue of this tall, narrow configuration, conventional dishwashing detergent squeeze bottle containers are very easily knocked over during normal activities conducted in the vicinity of a kitchen sink. When such containers are knocked over, dishwashing detergent frequently leaks from the open mouth of the container. This represents both a source of waste and also an annoyance, since the spilled dishwashing liquid must then be cleaned up.

As the dishwashing liquid is used from conventional squeeze bottle dishwashing detergent containers, the squeeze bottle container is inverted and a small quantity of dishwashing liquid forced therefrom by lateral pressure on the sides of the bottle. Once the required amount of dishwashing liquid has been obtained, the squeeze bottle is turned back upright and returned to its customary place in the kitchen. However, inevitably there is a small amount of dishwashing liquid that remains on the exterior of the nozzle. Once the squeeze bottle container is returned to its upright disposition, the dishwashing liquid drips down the side of the bottle. Should someone merely wish to move the bottle by manually grasping it, the contact of the persons hand with the bottle frequently leaves the user's hand covered with sticky dishwashing detergent.

Another inconvenience that exists in the kitchens of many households is the absence of a holder system for conveniently storing a kitchen sponge and dishwashing liquid in close proximity to each other. Very frequently, the sponge is placed on the edge of a kitchen sink. As the sponge drains, dirty residue from it will frequently collect on the sink. Also, the sponge will frequently be inadvertently knocked into the kitchen sink, or otherwise become temporarily lost or misplaced. Also, because the sponge typically rests on a hard, water impervious surface, the sponge tends to remain damp for extended periods of time. As a consequence the sponge tends to deteriorate more rapidly than it would if dried regularly. In addition, damp sponges tend to emit musty, unpleasant odors.

To solve these and other problems associated with the storage and use of liquid cleaning substances such as dishwashing detergents, a unique apparatus for dispensing a liquid cleaning substances has been devised.

SUMMARY OF THE INVENTION

In one broad aspect the present invention may be considered to be an apparatus for dispensing liquid detergents comprising a base, means for supporting a liquid detergent dispenser above the base wherein the liquid detergent dispenser has a dispensing orifice located at an elevated level above the base, a concave upwardly facing liquid detergent receptacle located atop the base and directly beneath the dispensing orifice, and a sponge support hinged relative to the base to rotate about a horizontal axis between a lowered horizontal disposition directly above the liquid detergent receptacle and a raised disposition out of vertical alignment with the dispensing orifice and the liquid detergent receptacle. The apparatus of the invention provides a convenient means for dispensing a dishwashing detergent or other liquid cleaner, and for organizing and storing the implements utilized with such liquid cleaners.

One object of the present invention is to provide a device for dispensing liquid detergent or other liquid cleaners that includes a means for organizing the implements normally utilized with liquid detergent. Specifically, the apparatus of the invention provides a support for a kitchen sponge above a detergent receptacle. The support is preferably formed as a mesh screen hinged to the rear edge of the detergent receptacle. Alternatively the support may be formed as a U-shaped wire hinged to the rear of the detergent receptacle and extending about the front and sides of the upper edge of the receptacle. Either construction allows the sponge to dry, since the sponge does not rest upon a solid surface and thereby entrap water. Rather, the sponge support allows the sponge to be more fully exposed to ambient air and thereby dry out more readily. This leads to a reduction in unpleasant odors which a damp, soiled sponge frequently emits. It also prolongs the useful life of the sponge.

Another object of the invention is to provide a liquid cleaner dispensing apparatus that holds not only a liquid cleaning substance, but also a sponge used to apply the liquid cleaning substance, and in addition a brush holder and a hand soap tray as well. The brush holder and hand soap tray are mounted on the same stand as the liquid cleanser container and in lateral displacement therefrom.

A tray is provided directly beneath the dispensing orifice of the liquid detergent container. A quantity of the liquid detergent can be dispensed from the liquid detergent container directly into the tray. The user can then lift the hinged screen forming the sponge rest, and dip either the sponge or the scrubbing element of the brush into the liquid detergent tray to obtain a desired amount of liquid detergent. The device thus provides a convenient reservoir into which cleaning implements, such as sponges and brushes can be dipped to obtain cleaning detergent as necessary.

Furthermore, the arrangement of the liquid cleaner container and the liquid soap tray therebeneath prevents the soap from being wasted. Any soap that is dispensed from the container will fall directly into the tray. Any portion of that soap that is not utilized immediately following its dispensation will remain within the liquid soap tray and is available for subsequent use. Moreover, the liquid soap tray is provided with a lid, preferably in the form of the hinged mesh screen, that may he lifted for access to the liquid soap in the tray, and lowered to provide a sponge support directly atop the soap tray.

In one embodiment of the invention the means for supporting the liquid detergent dispenser is comprised of an upright stanchion that rises from the base, and a bracket for holding the liquid detergent container. In this embodiment the container has a bottom in which the liquid dispensing orifice is defined as a circular hole at the axial center of the bottom of the container. A valve closure element is provided and is movable to a closed position plugging the liquid dispensing orifice and alternatively to an open position for unplugging the liquid dispensing orifice. The valve closure element is biased toward the closed position. A valve actuator element is also provided and is accessible from outside the container. The valve actuator element is operable to move the valve closure element from the closed to the open position.

The valve closure element may be located beneath the liquid dispensing orifice and the liquid detergent container may have a top. The valve actuator element may include a valve push rod extending vertically upwardly from the valve closure element to the top of the liquid detergent container. A plunger is coupled to the push rod and is accessible from the top of the liquid detergent container. A spring may be provided to bias the valve closure element and the valve actuator element upwardly to seal the liquid dispensing orifice.

The valve closure element preferably includes a resilient, liquid impervious seal that seats against the liquid dispensing orifice when the valve closure element is in the closed position. This seal prevents liquid detergent or any other liquid cleaner from leaking through the liquid dispensing orifice when the valve closure element is closed.

An alternative embodiment of the invention may be provided for use with a hollow liquid detergent container having a mouth at its upper extremity and including a pump mechanism secured in the container mouth. The pump mechanism typically has a laterally projecting spout. In this embodiment the liquid dispensing orifice of the invention is defined in the laterally projecting spout. A surrounding wall projects upwardly from the base to laterally enclose the liquid detergent container. The laterally enclosing wall thereby serves to consistently position the liquid detergent container so that the laterally projecting spout will extend to a position located directly above the liquid detergent receptacle or soap tray. Thus, any liquid detergent dripping from the spout will fall into the liquid soap tray, and will not fall onto the kitchen counter.

The invention may be described with greater clarity and particularity by reference to the accompanying drawings.

DESCRIPTION OF THE EMBODIMENTS

Figure 1:
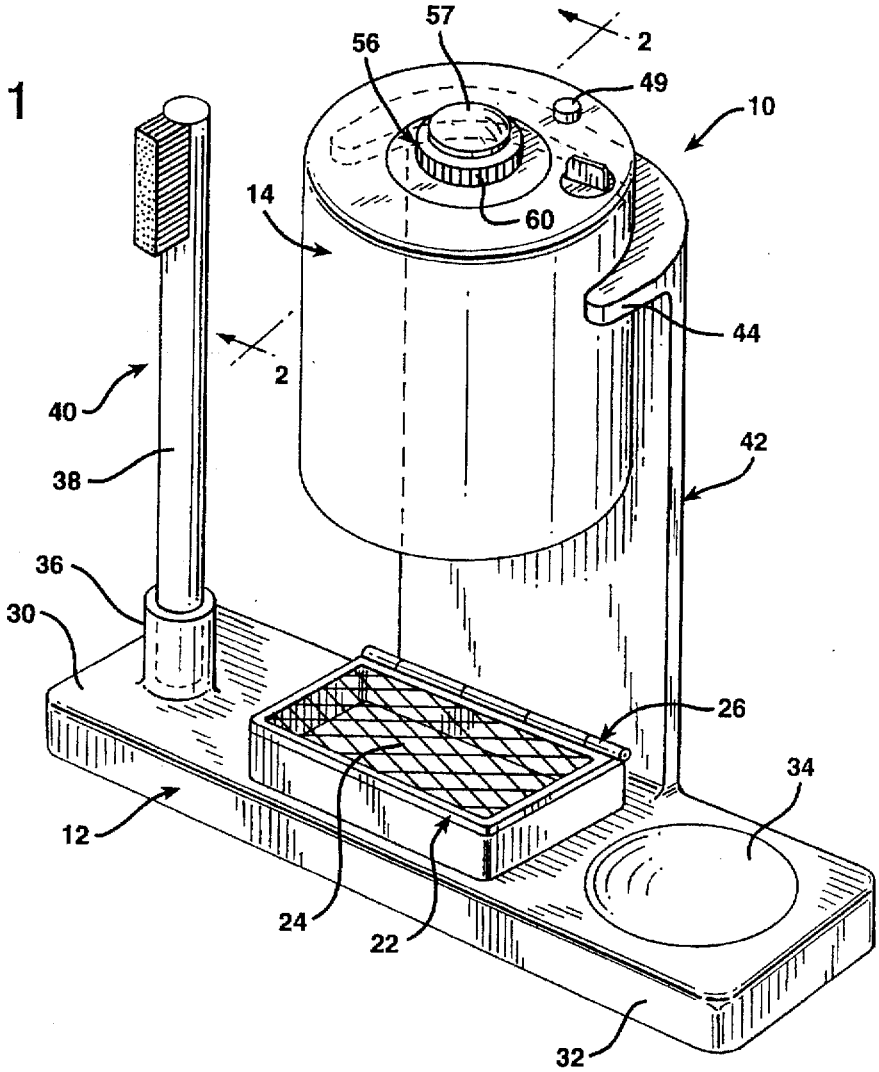
FIG. 1 is a perspective view of one preferred embodiment of the invention.

FIG. 1 illustrates generally at 10 an apparatus for dispensing a liquid cleaning substance, such as dishwashing detergent. The apparatus 10 is comprised of a mounting base 12, and a container 14 mounted atop the base 12 and holding a liquid cleaning substance indicated at 16 in FIG. 2. The container 14 has a dispensing port indicated at 18 in FIG. 2 which is located above the base 12 and which is used to dispense the liquid cleaning substance 16 from the container 14. A concave liquid cleaning substance receptacle 20 is located on the base 12 and is removably disposed to receive the liquid cleaning substance 16 falling vertically from the dispensing port 18. The apparatus 10 also includes a rectangular lid 22 formed of an open mesh screen 24 hinged for rotation relative to the base 12 about a horizontal axis by means of a hinge 26. The screen 24 is rotatable from a lowered position for supporting a sponge 28 thereon directly above the liquid cleaning substance receptacle 20, as depicted in solid lines in FIG. 2, and a raised position indicated in phantom at 22'. When the lid is in the raised position 22' the user is provided with access to the liquid cleaning substance receptacle 20.

Figure 2:
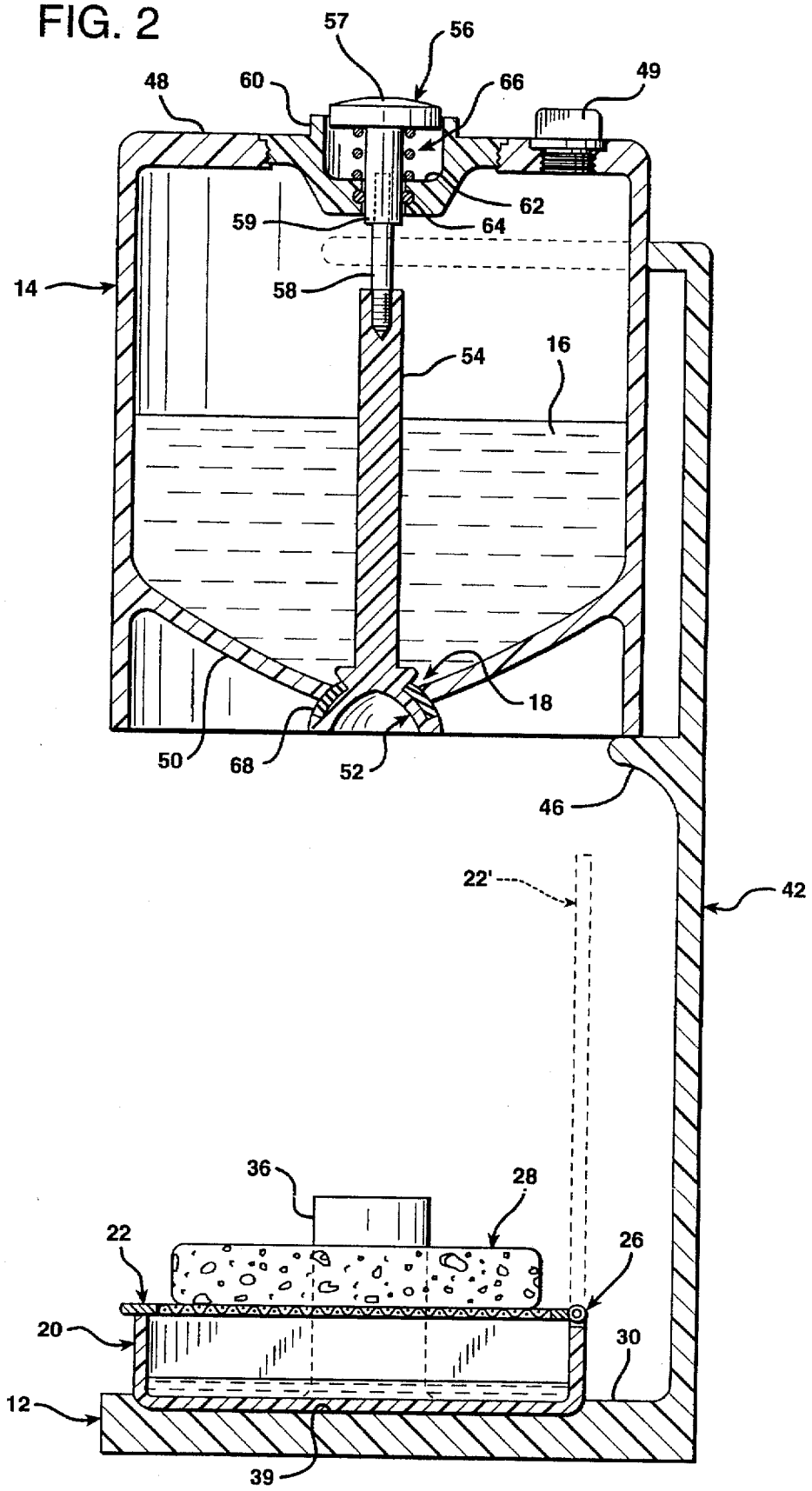
FIG. 2 is a sectional elevational view of the embodiment of FIG. 1 taken along the lines 2—2 thereof.

In the embodiments of FIGS. 1 and 2 the base 12 is formed as a molded plastic pad having a generally rectangular top surface 30. The pad is thick enough so that the top surface 30 resides at a slight elevation of about three quarters of an inch above the surface upon which the base 12 rests. A shallow upwardly facing concave depression 34 is formed at one end of the top surface 30 and serves as a hand soap tray for accommodating a bar of hand soap. At the opposite end of the top surface 30 there is an integrally formed upright, tubular annular brush holder 36. The brush holder 36 has an interior diameter of a size suitable to hold the handle 38 of a conventional kitchen utensil brush 40 in an upright disposition. Both the hand soap tray 34 and the tubular brush holder 36 are laterally displaced from the container 14. A shallow, rectangular recess 39 is defined at the center of the top 30 to serve as a positioning guide for the cleaning substance receptacle 20. The rectangular depression 39 ensures that the cleaning liquid substance receptacle 20 can always be properly positioned in direct vertical alignment with the port 18.

At the rear of the base 12 an upright stanchion 42 rises above the top surface 30 of the base and extends upwardly to terminate in a horizontally disposed generally U-shaped bracket 44 that is adapted to hold the cylindrical container 14 in position vertically above the liquid cleaning substance receptacle 20. The opposing arms of the bracket 44 extend in an arc slightly greater than 180 degrees about the circumference of the container 14 and have a certain amount of resiliency. The stanchion 42 includes a forwardly projecting tang 46 located some distance below the bracket 44, as shown in FIG. 2. The tang 46 serves to support the container 14 by providing a bearing surface upon which the lower, cylindrical edge of the peripheral skirt of the container 14 rests.

The container 14 may be removeably inserted into the bracket 44 by bringing it into a position just above the tang 46, and pressing the container 14 laterally in between the arms of the bracket 44. The bracket arms will flex slightly to admit the container 14 and to constrain it from lateral movement. The tang 46 supports the weight of the container 14 and its contents. Since the arms of the bracket 44 pass more than halfway around the circumference of the container 14, a conscious, lateral force is required to remove the container 14 from the stanchion 42, as the arms of the bracket 44 will otherwise retain the container 14 in an elevated position resting on the tang 46.

The container 14 is a hollow, cylindrical tank-like structure which has a generally flat, disc-shaped top 48 and a concave upwardly facing bottom 50. A fill opening is defined in the top 48 of the container 14. As shown, the fill opening is normally closed by an externally threaded plastic plug 49. When the supply of liquid detergent in the container 14 must be replenished, the plug 49 is unscrewed from the fill opening and additional detergent added. The plug 49 is then re-engaged in the fill opening.

The bottom 50 slopes downwardly and inwardly from the outer cylindrical wall of the container 14 to define the port 18. The port 18 of the container 14 is formed as a circular opening at the axial center of the bottom 50 of the container 14.

The container 14 is provided with a valve mechanism that includes a valve closure element 52 that is moveable between a closed position to block the dispensing port 18, as illustrated in FIG. 2, and an open position. To reach the open position the valve closure element 52 is pushed downwardly from the position of FIG. 2 a short distance so as to create an annular gap between the outer surface of the valve closure element 52 and the interior edge of the container bottom 50 defining the port 18. In this lowered, open position the valve closure element 52 unblocks the port 18.

The valve mechanism also includes a valve actuator. The valve actuator is formed by a vertical actuator push rod 54 that is connected at its lower extremity to the valve closure element 52, a plunger 56, and a connecting rod 58. Together, the actuator push rod 54, the connector push rod 58, and the plunger 56 project upwardly through the axial center of the container 14. The plunger 56 is formed with a generally disc-shaped upper push button 57, rounded across the top, and a cylindrical annular socket 59 extending downwardly from the disc-shaped upper push button portion 57. The cylindrical annular socket 59 receives the upper extremity of the connecting rod 58 in tight, frictional engagement therewith. The lower tip of the connecting rod 58 is externally threaded and is threadably engaged in an internally tapped bore in the upper extremity of the actuator push rod 54, as illustrated in FIG. 2.

The plunger 56 is disposed within the lateral confines of an annular boss 60 defined in the top 48 of the container 14. Within the boss 60 a pocket 62 is formed to accommodate vertical movement of the upper push button portion 57 of the plunger 56. At the axis of the top 48, at the center of the pocket 62, a circular opening is defined which is of a diameter just sufficient to allow free movement of the depending socket 59 of the plunger 56. An O-ring 64 set into the interior, annular edge of the top 48 forms a sliding, liquid tight seal about the outer surface of the socket 59.

The valve mechanism of the embodiment of FIGS. 1 and 2 is also equipped with a spring biasing means in the form of a compressed coil spring 66 that acts between the container 14 and the valve closure element 52 to urge the valve closure element 52 toward the closed position depicted in FIG. 2. That is, the coil spring 66 is compressed between the underside of the plunger push button 57 and the upwardly facing bearing surface of the pocket 62 so as to force the plunger 56 vertically upward. The plunger 56 thereupon exerts a longitudinal, axial force on the connecting rod 58 and the actuator push rod 54 to pull the valve closure element 52 upwardly.

The externally threaded tip of the connector rod 58 and the internally threaded bore defined in the upper end of the actuator push rod 54 serve as a bias adjustment means. That is, by rotating or counterrotating the plunger 56, the connecting rod 58 can be advanced downwardly deeper into the tapped bore of the actuator push rod 54, or partially withdrawn therefrom. The further the threaded tip of the connector rod 58 is engaged in the bore in the upper extremity of the actuator push rod 54, the more the coil spring 66 will be compressed. Increased compression of the coil spring 66 produces an increased upward force on the plunger 56 and actuator push rod 54, thereby more tightly sealing the valve closure element 52 in the port 18. Conversely, if the plunger 56 is counterrotated to relieve some of the compressive force on the spring 66, the valve closure element 52 will be drawn upwardly with less force. The extent of engagement of the threaded tip of the connector rod 58 in the bore of the actuator push rod 54 should be adjusted so that there is no leakage of the cleaning detergent 16 through the port 18 past the valve closure element 52, while still permitting easy operation of the plunger 56.

As shown in FIG. 2, the valve closure element 52 includes a resilient, liquid impervious seal in the form of an annular rubber gasket 68. The outer surface of the valve closure element 52 defines an annular, channel-shaped gasket seat that accommodates the gasket 68. As shown, the gasket 68 seals against the orifice forming the port 18 when the valve closure element 52 is in the closed position.

To utilize the dishwashing detergent dispensing apparatus 10, a user replenishes the supply of liquid dishwashing detergent in the container 14 through the fill opening normally closed by the removable plug 49. When dishwahing detergent is required for cleaning dishes, or for any other purpose, the user merely momentarily depresses the plunger 56, thereby overcoming the bias of the compressed spring 66. The downward force on the plunger 56 forces the valve closure element 52 downwardly, away from its seated position blocking the port 18. Detergent can then flow through the narrow, annular gap defined by the orifice opening in the bottom 50 of the container 14 and the sealing gasket 68.

The user may place a sponge 28 on the lid 22 of the receptacle 20 so that the detergent will fall into and be absorbed by the sponge. The user can then use the sponge to clean dishes, wipe counters, and otherwise perform cleaning tasks in a kitchen. Alternatively, the sponge 28 may be removed from the lid 22 when the plunger 56 is depressed. In this case the detergent 16 will descend through the annular gap formed between the port 18 and the valve closure element 52 and fall vertically directly into the receptacle 20. The user can then dip a sponge, or the head of the brush 40 into the receptacle 20 and perform various cleaning tasks. The user has access to the receptacle 20 by raising the lid 22 to the position shown at 22' in FIG. 2.

When the user has finished with the cleaning tasks at hand, the sponge 28 is normally rinsed and placed atop the screen mesh 24 of the lid 22. Since the sponge 28 is out of contact with all liquids, it will dry in the ambient air and will not deteriorate as rapidly as it otherwise would if maintained in a constantly damp condition.

Figure 3:
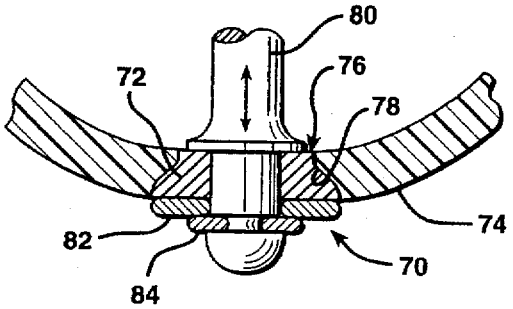
FIG. 3 is a sectional elevational detail showing an alternative embodiment of a valve closure mechanism to that depicted in FIG. 2.

FIG. 3 illustrates an alternative embodiment of a valve closure element to that depicted in FIG. 2. In the embodiment of FIG. 3 the valve closure element 70 is formed with a liquid impervious seal 72 in the form of a gasket structure, the exterior surface of which has a greater outer diameter at its lower extremity than its upper extremity. As shown in FIG. 3, the gasket 72 has a radially projecting lip at its lower extremity, and curves upwardly to its narrowest diameter. In this embodiment the opening at the center of the bottom 74 of the liquid detergent container is configured about the orifice 76 defined wherein to conform to the shape of the exterior surface of the gasket 72. As shown, the configuration of the opening 76 in the container bottom 74 is such as to define a downwardly facing bearing ledge 78 to receive the lower extremity of the gasket 72 in face to face bearing contact thereagainst when the valve closure element 70 is in the closed position depicted in FIG. 3. The gasket 72 is held in position at the lower extremity of the actuator push rod 80 by means of a retaining washer 82 and by a C-shaped clip 84 that fits into an annular grove about the lower extremity of the actuator rod 80.

By forming a bearing surface 78 against which the gasket 72 resides in abutment, a seal is formed with a greater surface of contact at the interface between the outer surface of the gasket 72 and the corresponding facing surface of the container bottom 74 defining the port 76 therewithin. Due to this greater surface of contact, there is less likelihood of leakage through the port 76.

Figure 4:
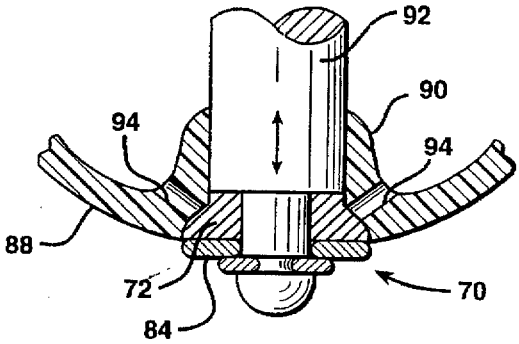
FIG. 4 is a sectional elevational detail showing another alternative embodiment of a valve closure element to that depicted in FIG. 2.

FIG. 4 illustrates another embodiment of a valve mechanism which may be employed in the apparatus 10. The valve closure element 70 of the embodiment of FIG. 4 is the same as that of FIG. 3. However, in the embodiment of FIG. 4 the center of the bottom 88 of the container is configured to define an upright annular guide 90 that receives and laterally constrains the lower extremity of the valve actuating push rod 92. Also, the dispensing port arrangement in the embodiment of FIG. 4 is comprised not only of a central, axial opening in the bottom 88, but also a plurality of inclined leak channel openings 94 that extend downwardly from the base of the guide 90 and intersect the central axial opening in the bottom 88. Typically there will be between about four and eight inclined leak channel openings 94 spaced uniformly about the base of the annular guide 90.

In the embodiment of FIG. 4 liquid detergent in the lower portion of the container flows downwardly and inwardly through the leak channel openings 94 and past the gasket 72 when the valve closure element 70 has been pushed downwardly so that the gasket 72 no longer blocks the leak channel openings 94. This embodiment has a distinct advantage in that the guide 90 serves as a means for laterally stabilizing the lower extremity of the actuator rob 92. The guide 90 guides the valve actuator push rod 92 to move the valve closure element 70 from the closed position depicted in FIG. 4 to the open position in which the orifices of the leak channel openings 94 are unblocked. Unless the plunger is depressed, however, the liquid impervious gasket 72 covers and seals all the openings at the lower extremities of the plurality of leak channel openings 94 when the valve closure element 70 is in the closed position, as depicted in FIG. 4.

Figure 5:
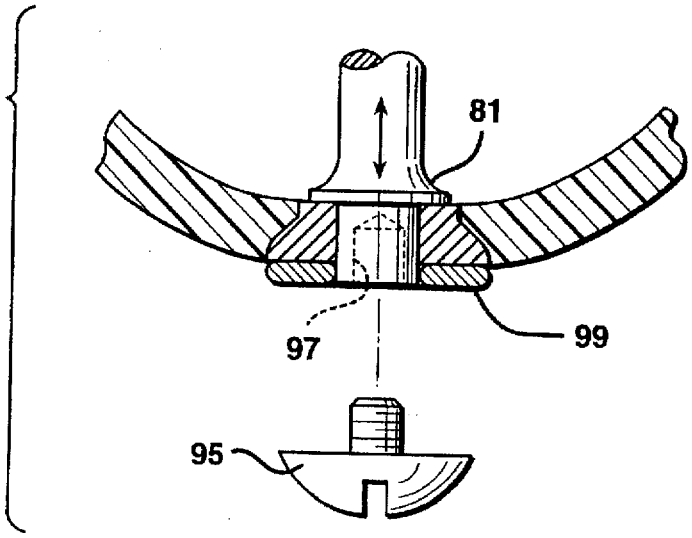
FIG. 5 is a sectional elevational detail showing still another alternative embodiment of a valve closure element to that depicted in FIG. 2.

FIG. 5 illustrates still another alternative valve arrangement to those depicted in FIGS. 2, 3, and 4. In this embodiment the gasket 72 and the actuator push rod 80 are the same as in the embodiment of FIG. 3. In FIG. 5 the retaining element is a threaded screw 95 directed upwardly and into an internally tapped bore 97 in the lower end of the actuator push rod 80. The screw 95 carries a fender washer 99 to compress the gasket 72 between the retaining screw 95 and the flange 81 at the lower end of the actuator push rod 80.

The valve arrangements of FIGS. 3, 4 and 5 all have an advantage over that of FIG. 2 in that the plunger, the connecting rod and the actuator push rod can all be formed as a single piece of unitary construction. This is because the lower extremity of the actuator push rod in each of those embodiments will fit through the central orifice at the bottom of the dispenser container. The plunger assembly and the plunger rod can be installed from above the soap dispenser and the gasket and gasket retaining element can be attached to the rod from beneath the orifice.

Figure 6:
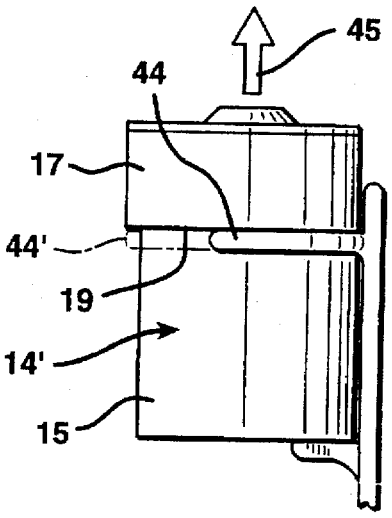
FIG. 6 is a side elevational detail illustrating an alternative embodiment of a container for holding a liquid cleaning substance to that depicted in FIGS. 1 and 2.
Figure 7:
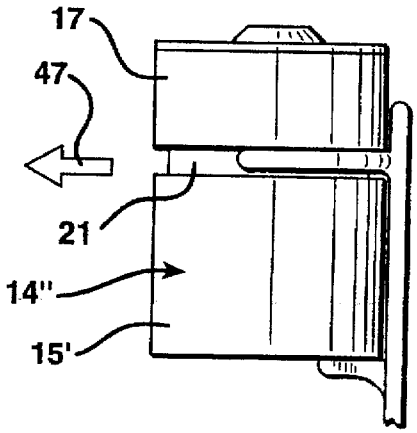
FIG. 7 is a side elevational detail illustrating still another alternative embodiment of a cleaning liquid container to that depicted in FIGS. 1 and 2.

FIGS. 6 and 7 illustrate other alternative embodiments of the container for holding a liquid cleaning substance to that depicted in FIGS. 1 and 2. The container 14' shown in FIG. 6 has a lower portion similar in configuration to the container 14. However, the upper portion of the container 14' includes a stepped section 17 of diameter larger than that of the lower portion 15. At the demarcation between the upper and lower sections 15 and 17 there is a downwardly facing annular bearing ledge 19 that extends around the entire circumference of the container 14'.

The arcuate arms of the bracket 44 snugly encircle the lower cylindrical portion 15 of the liquid detergent container 14'. However, the upper portion 17 of the container 14' is of a diameter larger than that defined with the embrace of the arms of the bracket 44. As a consequence, the bearing ledge 19 forms an abutting surface which is supported from beneath by the opposing, arcuate arms of the bracket 44. The bracket 44 thereby forms a firmer support against downward pressure exerted on the plunger 56 than is provided with the embodiment of FIG. 2.

Also, as shown in phantom in FIG. 6 at 44', the bracket 44 can be configured as an encircling annular ring extending laterally outwardly from the upright stanchion 42. With this arrangement the ring 44' will completely encircle the lower cylindrical portion 15 of the container 14' so that the bearing surface 19 is supported from beneath throughout its entire area. In this arrangement the container 14' can only be removed by lifting directly upwardly as indicated by the directional arrow 45 shown in FIG. 6. With this arrangement the bracket 44 does not need to tightly grip the lower portion 15 of the container 14'. As a consequence, the container 14' can be removed from the bracket 44 by lifting directly upwardly from beneath with less effort than is required to remove the container 14 from the bracket 44 in the embodiment of FIGS. 1 and 2.

FIG. 7 illustrates still another embodiment of a liquid detergent container 14". In this arrangement the upper portion 17 of the container 14" is identical to the upper portion 17 of the container 14' shown in FIG. 6. However, in the embodiment of FIG. 7 the lower portion 15' is also formed of a larger diameter equal to the diameter of the upper portion 17, and a region of reduced diameter is formed into a waist 21 at the transition between the upper and lower container portions 17 and 15'. The reduced diameter of the waist 21 accommodates the embracing arms of the bracket 44. The arms of the bracket 44 grip the waist 21 in the same manner as they grip the container 14 in the embodiment of FIGS. 1 and 2. However, the container 14" can be removed from the bracket 44 only by lateral withdrawal from the embrace of the bracket 44 by a force exerted in the direction of the arrow indicated at 47. The container arrangement of FIG. 7 provides an advantage in that the liquid detergent dispensing container 14" is less likely to be accidently dislodged from the bracket by inadvertent jostling from beneath. This could otherwise occur by a user inadvertently striking the bottom of a container 14" from beneath while removing the sponge 28 from the sponge support 22.

The embodiments of FIGS. 6 and 7 can be constructed so as to be more readily removable from the upright stanchion 42. This allows a user the flexibility of removing the liquid detergent container from the stanchion 42 for the purpose of dispensing larger volumes of detergent directly into a kitchen sink.

Figure 8:
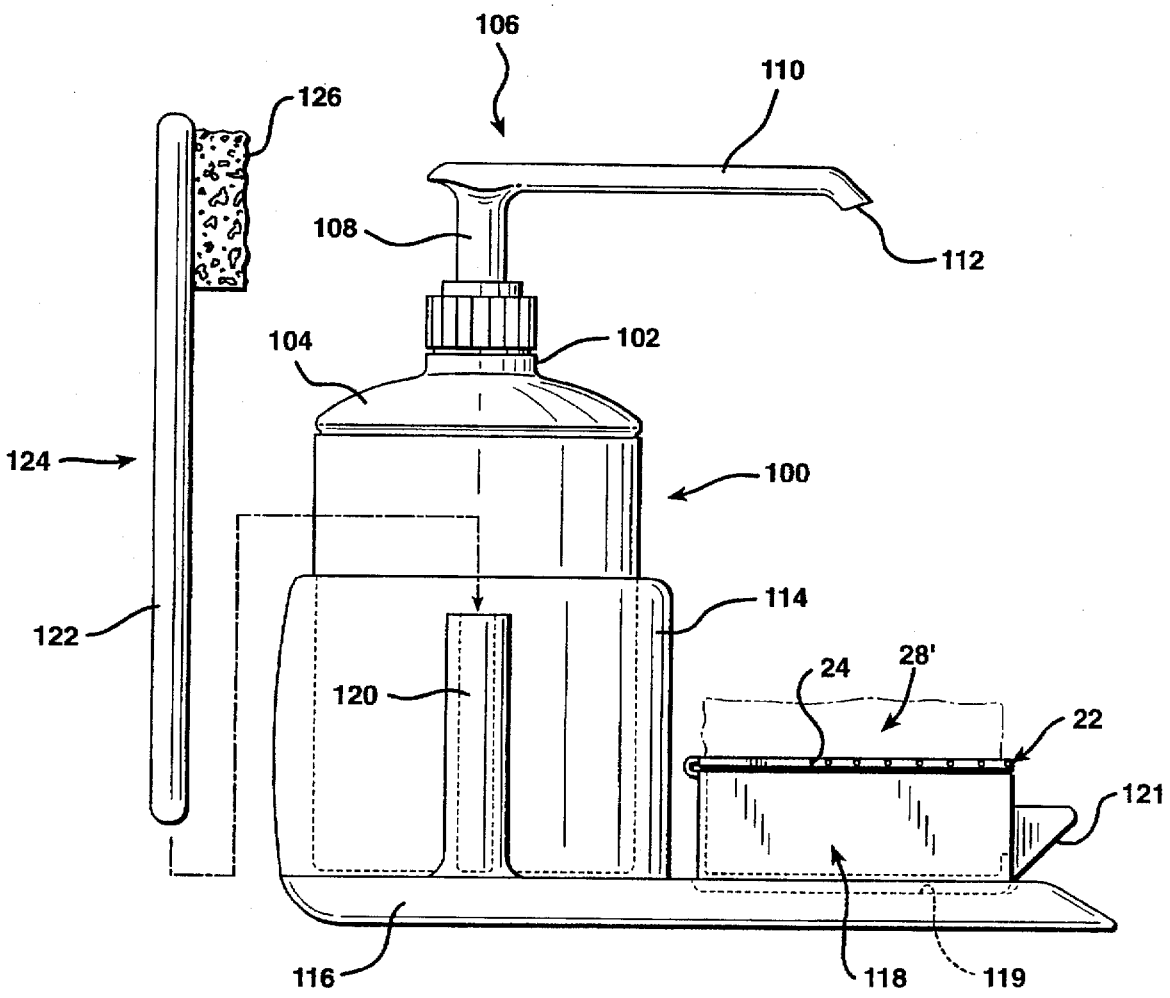
FIG. 8 is a side elevational view of an alternative embodiment of the invention.

FIG. 8 illustrates an embodiment of the invention considerably different from that of FIGS. 1–4. In the embodiment of FIG. 8 the container 100 is of the type quite different from the container 14. The container 100 is a pump style dishwashing detergent dispenser. That is, the container 100 is entirely closed across its bottom and has a mouth 102 at the center of its top 104. A pump mechanism 106 is mounted in the container mouth 102. The pump mechanism 106 is of a conventional type that has a downwardly projecting, hollow stem 108, and a laterally projecting spout 110. The dispensing port 112 of this embodiment is defined at the laterally projecting tip of the spout 110.

In the embodiment of FIG. 8, an upright, generally cylindrical, annular wall 114 is defined atop the base 116. The wall 114 rises from the base and defines a seat for the container 100 therewithin. In this embodiment the liquid detergent container 100 is seated within the confines of the encircling wall 114.

In the embodiment of FIG. 8 the liquid detergent receptacle 118 is removably positioned in a depression 119 formed in the upper surface of the base 116 so that the liquid detergent receptacle 118 will be located directly vertically beneath the port 112 of the spout 110.

To dispense detergent the user presses downwardly on the pump mechanism 106, thereby forcing the pump stem 108 vertically downwardly into the mouth 102. Through the conventional internal mechanism of the pump 106 liquid detergent is forced upwardly through the hollow pump stem 108 and passes laterally through the spout 110 and is ejected from the port 112. As in the embodiments of FIGS. 1–3, the detergent will fall directly downwardly toward the liquid detergent receptacle 118. If a sponge is positioned thereatop, as shown in phantom at 28' in FIG. 5, the sponge will absorb the detergent. Otherwise, the detergent will pass through the screen mesh 24 of the lid 22 and into the receptacle 118.

The front panel 121 of the receptacle 118 is angled outwardly at an angle of about 45 degrees about one half inch in from both ends of the receptacle 118. This provides an enlarged opening to the receptacle 118 at its front for easier access. The user is thereby provided with more room to insert a sponge or other cleaning implement into the receptacle 118.

In the embodiment of FIG. 8, the brush holder 120 is adapted to receive the handle 122 of any type of conventional soap cleaning brush. For example, the head 126 of the brush 124 may be formed of a sponge material, bristles, or a mat of fiberglass or nylon. Also, it may be desirable to include a hand soap tray on the base 116. This can be done by merely extending the length of the base to the right as viewed in FIG. 8 and forming a hand soap tray 34 in this extended portion of the base.

Undoubtedly, numerous other embodiments of the invention will become readily apparent to those familiar with household detergent dispensing devices. For example, the coil spring 66 can be replaced with a compressible rubber or polyurethane foam spring. Also, a U-shaped wire sponge support can be hinged to the soap receptacle to support the sponge about its peripheral edges in place of the wire mesh screen utilized in the embodiments illustrated. In addition, while the dispensing apparatus has been illustrated as being a supported on a counter, it can also be constructed as a wall mounted device. In this case the stanchion would be configured to receive conventional wall mounting fasteners, so that the device can be hung on the wall rather than supported from beneath on a counter. Accordingly, the scope of the invention should not be construed as limited to the specific embodiments depicted and described.

I claim:

1. Apparatus for dispensing liquid detergent comprising: a base, a liquid detergent container located above said base wherein said liquid detergent container has a dispensing orifice located at an elevated level above said base, means for coupling said liquid detergent container to said base thereby establishing a fixed distance of separation therebetween, a concave, upwardly facing liquid detergent receptacle located atop said base and directly beneath said dispensing orifice, and further comprising a tubular brush support projecting upwardly from said base, a brush having an elongated handle that is insertable into said brush support and is removable therefrom, and a soap bar tray located atop said base.

2. Apparatus for dispensing a liquid cleaning substance comprising a base, a container mounted atop said base and holding a liquid cleaning substance and having dispensing port means located above said base for dispensing said liquid cleaning substance from said container at an elevated level above said base, a concave liquid cleaning substance receptacle located on said base and disposed to receive said liquid cleaning substance falling vertically from said dispensing port means and further comprising an upright tubular brush holder and a hand soap tray both laterally displaced from said container atop said base.

3. A liquid cleaner dispensing apparatus comprising in combination: a base formed with a top surface, a stanchion projecting upwardly from said top surface of said base, a liquid cleaner container supported by said stanchion above said base and having upper and lower portions with a valve closure element and valve port means in said lower portion and with a valve actuator extending externally from said container, means for biasing said valve closure element to a closed position blocking said valve port means, a concave, upwardly facing liquid soap tray located vertically beneath said valve port means, and a hand soap tray defined atop said base and laterally displaced from said liquid cleaner container.

4. Apparatus according to claim 3 further comprising a guide means within said liquid cleaner container for guiding said valve actuator to move said valve closure element from said closed position to said open position.

5. Apparatus according to claim 3 wherein said stanchion is configured for attachment to a wall and said receptacle is removable from said base.

6. Apparatus for dispensing liquid detergent comprising: a base, a liquid detergent container located above said base wherein said liquid detergent container has a dispensing orifice located at an elevated level above said base, an upright stanchion rising from said base for coupling said liquid detergent container to said base thereby establishing a fixed distance of separation therebetween, and a concave, upwardly facing liquid detergent receptacle located atop said base and directly beneath said dispensing orifice, and wherein said container has a bottom in which said liquid dispensing orifice is defined, a valve closure element including a resilient, liquid-impervious seal and which is moveable to a closed position for plugging said liquid dispensing orifice and to an open position for unplugging said liquid dispensing orifice, and said resilient, liquid impervious seal seats against said liquid dispensing orifice when said valve closure element is in said closed position, and wherein said liquid impervious seal is a structure the exterior surface of which has a greater outer diameter at its lower extremity than at its upper extremity, and said bottom of said liquid detergent dispenser is configured about said orifice to conform to the shape of said exterior surface of said liquid impervious seal and defines a downwardly facing bearing ledge to receive said lower extremity of said liquid impervious seal in bearing contact thereagainst when said valve closure element is in said closed position, and wherein said valve closure element is biased toward said closed position, and further comprising a valve actuator element accessible from outside said container and operable to move said valve closure element from said closed to said open position.

* * * * *